United States Patent [19]

Hwang et al.

[11] Patent Number: 4,558,569

[45] Date of Patent: Dec. 17, 1985

[54] STUCK PUSHBUTTON CONTINGENCY OPERATION FOR A STEAM TURBINE CONTROL SYSTEM

[75] Inventors: Eddie Y. Hwang, Winter Park, Fla.; Wu-Shi Shung, South Windsor, Conn.; Robert L. Osborne, Winter Springs, Fla.

[73] Assignee: Westinghouse Electric Corp., Pittsburgh, Pa.

[21] Appl. No.: 572,720

[22] Filed: Jan. 20, 1984

[51] Int. Cl.[4] ..... F01K 13/00

[52] U.S. Cl. ..... 60/657; 91/429

[58] Field of Search ..... 415/118; 60/657, 646; 91/429

[56] References Cited

U.S. PATENT DOCUMENTS 4,095,119 6/1978 Nangle et al. ..... 60/646 X 4,368,520 1/1983 Hwang et al. ..... 60/646 X

*Primary Examiner*—Allen M. Ostrager

*Attorney, Agent, or Firm*—D. Schron

[57] ABSTRACT

A steam turbine control system which includes a manual panel with pushbuttons for operator control of the steam admission valves. Each valve has its own control means and is responsive to pushbutton activation to govern its valve movement. If a pushbutton indicating valve opening or closing gets stuck, the operator pushes a pushbutton indicating opposite movement and the control means switches to a special control mode after a predetermined period of time. In the special mode valve movement stops after removal of the operator's finger pressure and valve movement is accomplished by activation of predetermined pairs of pushbuttons.

6 Claims, 5 Drawing Figures

STUCK PUSHBUTTON CONTINGENCY OPERATION FOR A STEAM TURBINE CONTROL SYSTEM

BACKGROUND OF THE INVENTION

1. Field of the Invention

The invention in general relates to steam turbine control systems having an auto/manual operator's panel and more particularly to pushbutton operation of the manual section.

2. Description of the Prior Art

In the field of steam turbine control, many systems exist which utilize a primary controller in the form of a programmable digital computer as well as a redundant or backup computer. The computer's capability to monitor, memorize, calculate, test and make instant decisions results in a control system which is faster, more accurate and far superior to purely mechanical or analog control systems.

An improved digital control system for a steam turbine has been developed which includes primary and redundant base controllers as well as interconnected and coordinated functional modules each having its own microcomputer to execute specific functions. That is, the control system structure is based upon distributed processing, with this modular architecture providing for greater flexibility and minimizing risk of control loss and total system shutdown due to any single failure. The system can be serviced while on-line without the necessity for shutting down the turbine's operation and servicing of the apparatus can be accomplished in a minimal amount of time. One example of such distributed processing turbine control system is described and claimed in U.S. Pat. No. 4,368,520 assigned to the assignee of the present invention and hereby incorporated by reference.

The control system of the referenced patent includes a plurality of valve position control circuits for controlling the steam admission valves, with each circuit including its own programmable digital computer in two-way digital communication with a base controller from which it receives signals relative to the individual valve control. The valve position control circuits are selectively addressable to receive a particular valve related signal from the controller to in turn generate an individual valve drive signal for the valve it is controlling. The system is operable both in an automatic and a manual mode and when in the manual mode all of the valve position control circuits function to receive operator-entered command signals.

The operator-entered command signals are generated by activation of certain pushbuttons on the manual section of an operator's panel. For example, the operator may want to change the turbine speed (or load) by moving the steam admission valves and depression of the appropriate pushbutton will effect the necessary movement.

If for some reason the activated pushbutton sticks, after removal of the operator's finger pressure, the valves will objectionally continue to move. The present invention provides for contingency operation in such stuck pushbutton situation.

SUMMARY OF THE INVENTION

A manual control panel includes pushbuttons (or switches, etc.) for raising (opening) and lowering (closing) the turbine steam admission valves at a first rate, as well as additional pushbuttons for varying said rate. When in a manual control mode, an operator activates the pushbuttons to effect desired valve movement. A control means for each valve is responsive to activation of the pushbuttons to govern valve movement in a first or normal mode of operation. The control means is additionally operable in a second or special mode of operation if two pushbuttons indicating opposite valve movement are concurrently activated (one being stuck, the other being operator activated) for a predetermined period of time. In the special mode of operation the operator may still control valve movement by selective activation of two predetermined pushbuttons, for raising the valve and two other predetermined pushbuttons, for lowering the valve, with both the raising and lowering being at the same rate, Operation switches back to the normal mode after the stuck pushbutton situation is corrected.

DESCRIPTION OF THE PREFERRED EMBODIMENT

Figure 1:
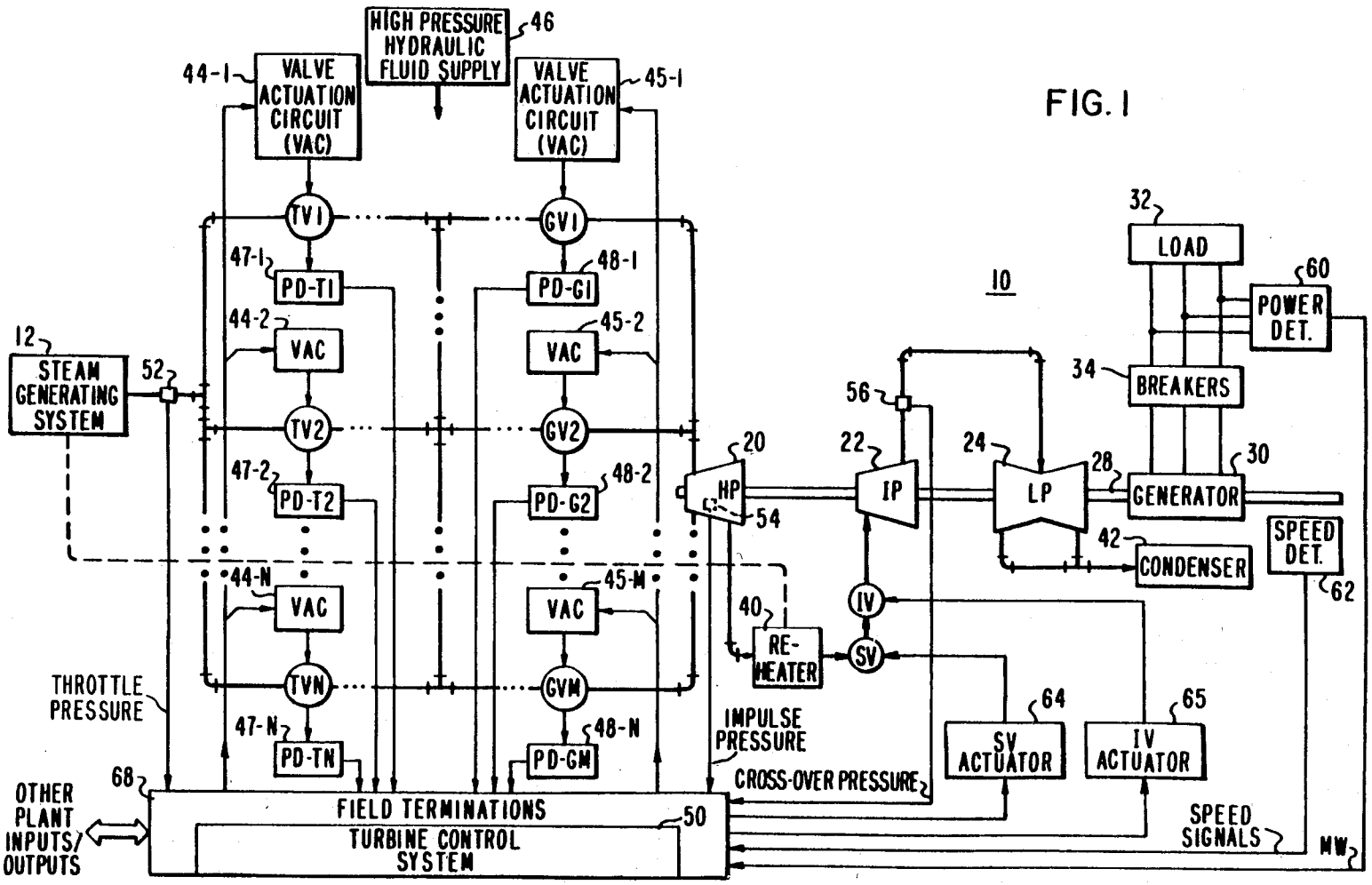
FIG. 1 is a block diagram of a steam turbine-generator power plant.

FIG. 1 depicts a steam turbine-generator power plant and is illustrated as a fossil-fired, tandem compound, single reheat turbine-generator unit by way of example. The arrangement includes a plurality of steam admission valves such as throttle valves TV1–TVN and governor valves GV1–GVM disposed in the main steam header which couples a steam turbine system 10 to a steam generating system 12. In a typical arrangement there may be four throttle valves (N=4) and eight governor valves (M=8).

Turbine system 10 includes a high pressure (HP) turbine 20, an intermediate pressure (IP) turbine 22 and a low pressure (LP) turbine 24, all of which are coupled to a common shaft 28 to drive an electrical generator 30 which supplies power to a load 32 through main breakers 34.

Steam exiting the HP turbine 20 is normally reheated in a reheater unit 40 generally a part of steam generating system 12 as indicated by the dotted line connection. Reheated steam is supplied to IP turbine 22 through one or more stop valves SV and one or more interceptor valves IV disposed in the steam line. Steam from the IP turbine 22 is provided to LP turbine 24 from which the steam is exhausted into a conventional condenser 42.

With the main breakers 34 open, the torque as produced by the inlet steam, is used to accelerate the turbine shaft 28 from turning gear to synchronous speed. As long as the main breakers 34 are open, the turbine is spinning with no electrical load and it is operative in a speed control mode. Once the shaft frequency is synchronized to the frequency of the load 32, which may be a power system network, the breakers 34 are closed, and power is delivered to the load by the generator 30.

When the breakers 34 close, the net torque exerted on the turbine rotating assemblies of the HP, IP and LP turbines controls the amount of power supplied to the load 32, while shaft speed is governed by the frequency of the power system network. Control of steam inlet under these conditions is generally referred to as load control, during which the turbine speed is monitored for purposes of regulating the power delivered to the load 32.

In order to control the turbine during operation, the steam admitting throttle and governor valves are controlled in position by respective valve actuation circuits 44 and 45 which receive high pressure fluid from a high pressure hydraulic fluid supply 46. Thus, valve actuation circuits 44-1 through 44-N respectively control throttle valves TV1--TVN and valve actuation circuits 45-1 through 45-M control governor valves GV1-GVM. Position detectors 47 and 48 are coupled to the valves to provide respective feedback signals indicative of valve position. Position detectors 47-1 through 47-N are coupled to respective throttle valves TV1-TVN and position detectors 48-1 through 48-M are coupled to respective governor valves GV1-GVM.

Control signals for operation of the valve actuation circuits are derived from a turbine control system 50 which utilizes indications of various plant parameters for control purposes. Among the various parameters utilized is an indication of throttle pressure derived from a throttle pressure detector 52 in the main steam line between the steam generating system 12 and the throttle valves. A detector 54 within the HP turbine 20 provides an indication of impulse pressure which is proportional to load, and a detector 56 in the crossover line between IP and LP turbines 22 and 24 provides an indication of crossover pressure. A power detector 60 coupled to the generator output provides a megawatt (MW) signal indicative of output electrical power. An additional input utilized by the turbine control system is an indication of speed which is obtained by speed detection circuitry 62.

In addition to controlling the valve actuation circuits for the throttle and governor valves, the turbine control system 50 is also possible to control the opening and closing of the stop valves and interceptor valves by respective valve actuation circuits 64 and 65.

Selected input signals to the turbine control system 50 from the plant, as well as output signals to the plant, are coupled to field termination networks 68 so as to provide for signal controlling and surge voltage protection.

Figure 2:
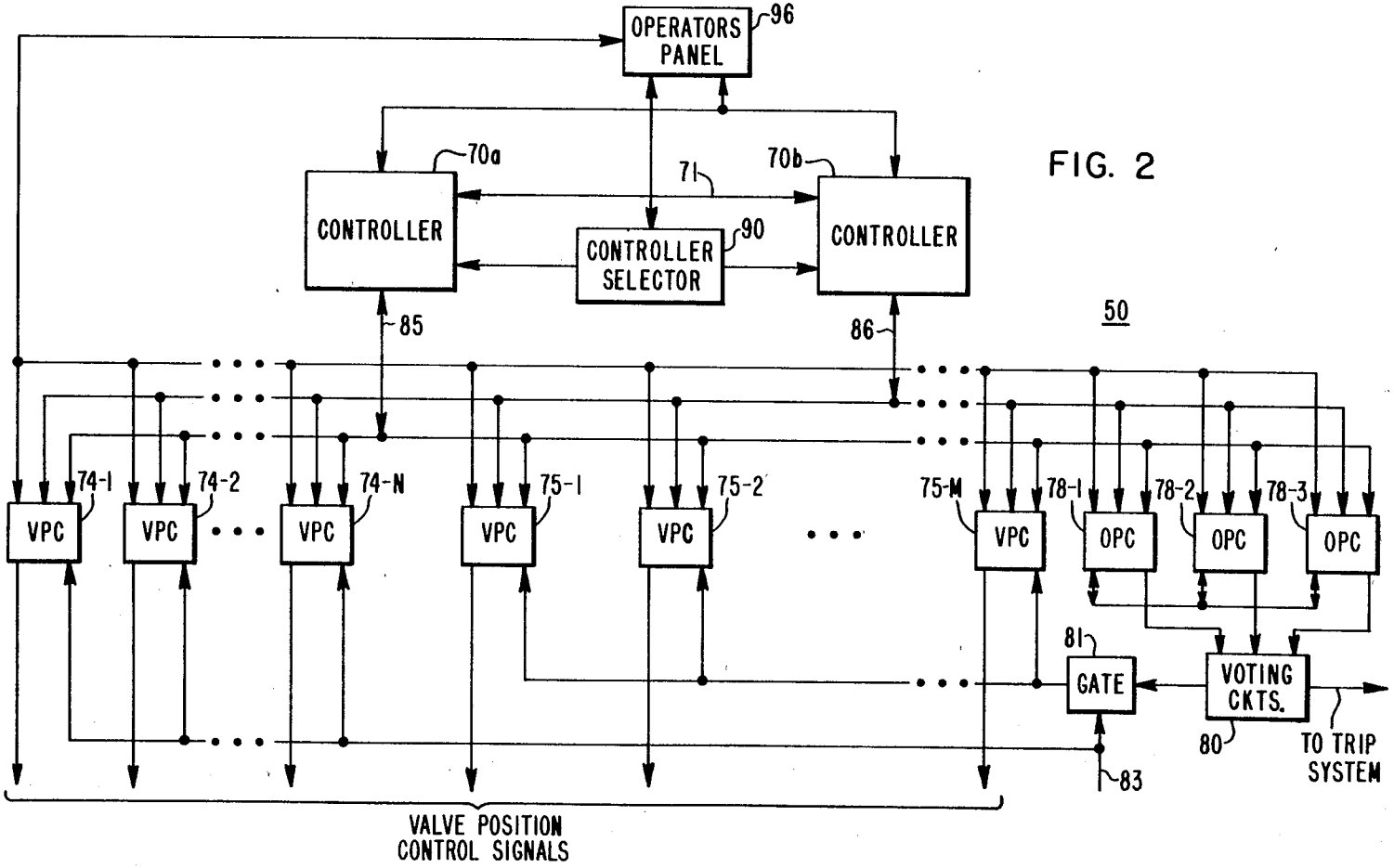
FIG. 2 is a block diagram of the turbine control system illustrated in FIG. 1.

A block diagram of a turbine control system 50 is illustrated in FIG. 2. The system includes a controller **70*a*, having memory means for storing digital information including data and operating instructions. Digital processing circuitry is provided for processing the digital information and the controller includes means for inputting and outputting information. The reliability of the overall system may be improved by incorporating a second controller 70*b* having the identical structure as controller 70*a***.

The system is divided into several interconnecting and coordinated functional modules with each functional module incorporating its own processing capability to execute its specific function. In FIG. 2, the functional modules include valve position control (VPC) circuits 74 and 75 for controlling respective throttle valve and governor valve actuation circuits. Thus, valve position control circuits 74-1 through 74-N provide control signals to valve actuation circuits 44-1 through 44-N and constitute throttle valve position control circuits. Valve position control circuits 75-1 through 75-M control respective valve actuation circuits 45-1 through 45-M and constitute governor valve position control circuits. Although not illustrated, valve position control circuits could also be provided for the interceptor valves. Each valve position control circuit includes its own memory means for strong digital information including data and operating instructions as well as digital processing circuitry for processing the digital information, such function ideally being provided by a microcomputer.

As more fully described and claimed in copending application Ser. No. 666,771 filed Oct. 31, 1984, speed monitoring and overspeed protection is provided by a plurality of OPC circuits such as 78-1, 78-2 and 78-3 communicative with one another and operable to interact directly with the governor valve position control circuits 75 through voting circuitry 80 and gate circuit 81 to initiate a closing of all of the governor valves upon a certain predetermined condition. Valve closing may also be effected by means of an external signal applied at lead 83, such signal being for example a turbine trip signal which is provided to gate 81 and to valve position control circuits 74-1 through 74-N.

By means of two-way digital data links 85 and 86, digital information may be conveyed from the valve position control and OPC circuits to both controllers **70*a* and 70*b*, whereas only one selected controller 70*a* or 70*b* transmits digital information down to the valve position control and OPC circuits. A controller selector 90 is operable to determine which controller is the primary controller and which is the backup controller and may be further operable to selectively choose data link 85 or 86** for downward transmission of digital information.

The turbine control system additionally includes an operator's panel 96 in two-way communication with both controllers **70*a* and 70*b*** as well as with all of the valve position control and OPC circuits. This latter connection enables various parameters to be communicated to the operator and allows the operator to place the system under direct manual control.

Figure 3:
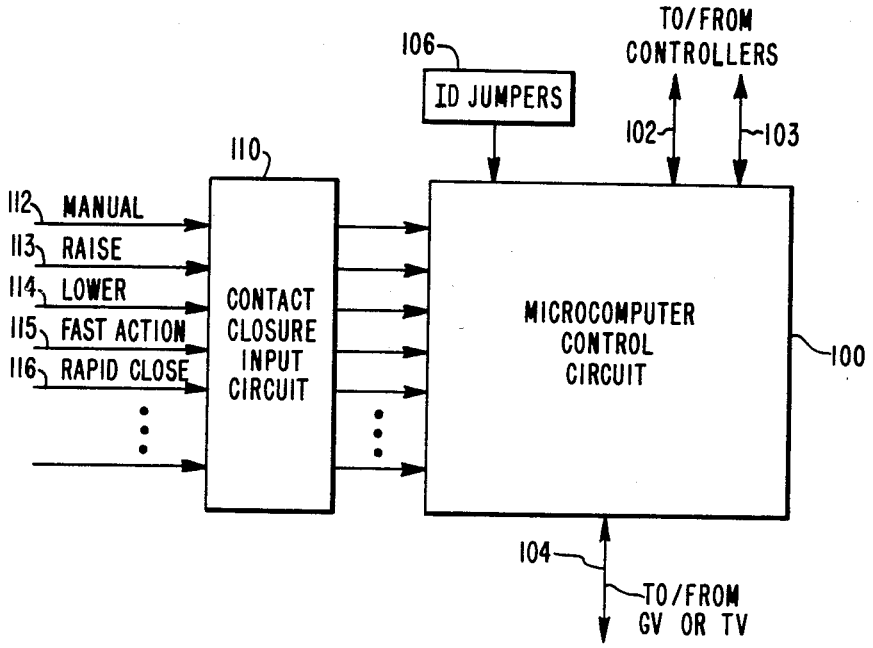
FIG. 3 is a block digram illustrating various components of a valve position control circuit utilized in the practice of the present invention.

Each valve position control circuit contains all of the hardware, firmware and software necessary to regulate the position of an individual valve be it a governor valve, throttle valve or interceptor valve. FIG. 3 shows some of the components of a typical valve position control circuit, further details of which are described in the referenced patent.

At the heart of the valve position control circuit is a control means preferably in the form of a microcomputer control circuit 100 having memory means for storing digital information including data and operating instructions, as well as digital processing circuitry for processing the digital information. Double ended arrows 102 and 103 represent digital information transfer between the valve position control circuit and the controllers **70*a* and 70*b* via the digital data links and double ended arrow 104** represents the control interaction with the valve being controlled.

The primary controller may selectively communicate with one of the valve position control circuits by transmitting a particular address or identification prior to the command. Although received by all valve position control circuits as well as OPC's, only that valve position control circuit corresponding to the address will accept the command, such address or identification being previously designated by means of an identification jumper assembly 106 by which an operator may insert predetermined combinations of mini-jumpers to designate whether the valve position control circuit is for governor valve, throttle valve or interceptor valve control, as well as to provide it with a specific identity.

Microcomputer control circuit 100 is operable to carry out operations in response to information provided by the primary controller via the digital data links when in an automatic mode of operation. Microcomputer control circuit 100 is additionally operable to receive information from the operator's panel when in a manual mode of operation and various signals initiated by the operator may be input to the microcomputer control circuit via the contact closure input circuit 110 which conditions the signals for presentation to the microcomputer. The signals operatively involved in the present invention include a MANUAL input on line 112, a RAISE input on line 113, a LOWER input on line 114, a FAST ACTION input on line 115 and a RAPID CLOSE input on line 116.

Figure 4:
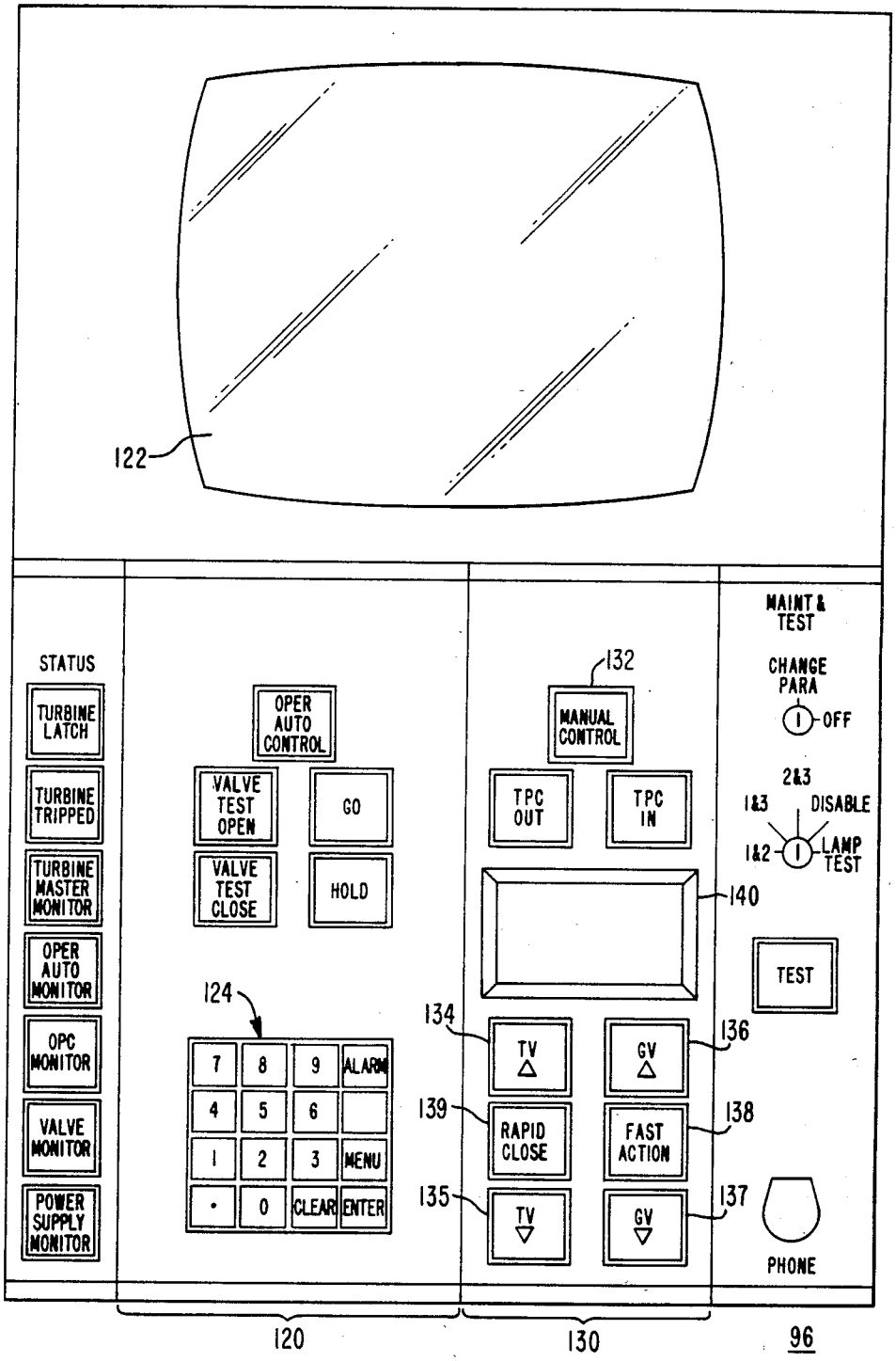
FIG. 4 illustrates the operator's panel of FIG. 2 in somewhat more detail.

A typical operator's panel is illustrated in FIG. 4 and represents an alternate form to that shown in the referenced patent in that only one level of automatic control is provided instead of two as in the patent. The automatic control section 120 is operational in conjunction with a CRT 122 and keyboard 124 for various operator interactions with the controllers 70*a* and 70*b*.

The manual section 130 is a backup control which is initiated by activation of the manual control pushbutton 132. When in the manual mode of operation, the throttle valves may be jointly raised or lowered by means of pushbuttons 134 and 135 and the governor valves may be jointly raised or lowered by means of pushbuttons 136 and 137. The terms raise or lower utilized herein refer to vertically oriented valves and correspond to the respective opening and closing of the valves. Similar pushbuttons may be provided for the interceptor valves in those systems wherein the interceptor valves have their own individual valve position control circuits are previously described.

The raising or lowering of the valves will be at a predetermined rate such as 5% per minute and a predetermined faster rate such as $33\frac{1}{3}$% per minute may be achieved with the additional activation of a fast action pushbutton 138. For emergency situations it may be desirable to rapidly close the valve, for example at a rate of 200% per minute, and a rapid close pushbutton 139 is provided for this purpose and is activated in conjunction with either pushbutton 135 or 137. Activation of the pushbuttons of the manual section input a corresponding signal directly into all of the valve position control circuits as illustrated in FIG. 3, via the respective signal conditioning contact closure input circuit 110. Although pushbuttons are illustrated, other forms of switch arrangements suc as toggles, capacitive, membranes, etc. may be utilized to input the indicated signals.

With additional reference to FIG. 3 let it be assumed by way of example that manual control is in effect and that the operator desires to raise the governor valves so as to increase turbine speed or load. The operator will depress the governor valve raise pushbutton 136, which action provides the RAISE signal on line 112. The microcomputer control circuit 100 includes in its repertoire of programs one for periodically scanning all of the inputs from circuit 110 so as to see if any of the indicated input signals are present. Such scanning programs are well known and may be executed such that the inputs are examined many times in the course of one second.

In a normal mode of operation, removal of the operator's finger pressure from the pushbutton 136 will remove its associated input signal and will cause the microcomputer control circuit 100 to cease movement of the governor valve it is controlling. If the operator wants to decrease the steam flow through the governor valves, pushbutton 137 will be activated, providing a LOWER signal on line 114 to effect the lowering of the governor valves by the microcomputer control circuits 100.

A similar philosophy governs operation of the throttle valves in that activation of pushbutton 134 provides the RAISE input signal on line 113 of a throttle valve position control circuit whereas activation of pushbutton 135 provides the LOWER input signal on line 114 thereof.

For raising or lowering the valves at a faster rate, the FAST action pushbutton 138, causing a fast ACTION input signal on line 115, is activated in addition to any of the selected pushbuttons 134–137. Activation of the rapid close pushbutton 139 causing a corresponding RAPID CLOSE input signal on line 116 is utilized only in conjunction with the lowering of the valves, that is, only with activation of pushbutton 135 or 137.

Suppose by way of example that the governor valves are being raised by activation of pushbutton 136 and that after removal of the operator's finger from the pushbutton, the pushbutton remains in a stuck position such that the valves still continue to open. This condition may be sensed by viewing a readout (not shown) showing the valve's position, or may be sensed by viewing a readout 140 which would be showing a rising speed (or load) even after removal of the finger pressure. In the present invention, movement of the valve is stopped by depressing the pushbutton indicating the opposite movement, that is, pushbutton 137. The microcomputer control circuit 100 is operative thereafter to switch from a normal mode of operation of a special mode of operation after a predetermined period of time wherein both the raise and lower pushbuttons are concurrently activated (one by being stuck and the other by the operator). After this special mode of operation has been initiated, finger pressure may be removed from pushbutton 137 and the valve will remain at its present position. The valve however may be still selectively raised or lowered at a single predetermined rate as will be described. This alternate mode of operation will continue until the stuck pushbutton is fixed, at which time a switch back to the normal mode is performed. The stuck button contingency operation by the microcomputer control circuit is further illustrated by the flow chart of FIG. 5 to which reference is now made.

Initially, as indicated by decision block 150, the determination is made as to whether or not the system is in manual control and if it is not, any activation of the pushbuttons on the manual section of the control panel is completely ignored, as indicated by block 152 at the lower right-hand portion of the figure.

When the system is in manual control, first and second timers designated respectively as a normal timer and a special timer, are established and initially set so that their timer count is zero. Thus, if the normal timer count equals zero, as indicated by decision block 154, and the special timer count equals zero, as indicated by decision block 156, then the count in the special timer is set to its maximum value as indicated by block 158.

If the raise and lower pushbuttons are not both activated, as indicated by decision block 160, then the count in the normal timer is set to its maximum value as indicated by block 162. Thereafter, the microcomputer control circuit will function in a normal mode of operation indicated by block 164 and which operation is summarized by the following chart wherein a "1" represents an activated pushbutton, a "0" represents a deactivated pushbutton and a "—" represents a don't care situation. Rates and times are given merely by way of example.

NORMAL MODE

| Raise Push-button (134 or 136) | Lower Pushbutton (135 or 137) | Fast Action Pushbutton (138) | Rapid Close Pushbutton (139) | Valve Response |
|---|---|---|---|---|
| 1 | 0 | 0 | — | Valve raises at 5% per min. |
| 0 | 1 | 0 | 0 | Valve lowers at 5% per min. |
| 1 | 0 | 1 | — | Valve raises at 33⅓% per min. |
| 0 | 1 | 1 | 0 | Valve lowers at 33⅓% per min. |
| 0 | 1 | 0 | 1 | Valve lowers at 200% per min. |
| 1 | 1 | — | — | Valve stops moving. Switch to special mode after 5 secs. |

Figure 5:
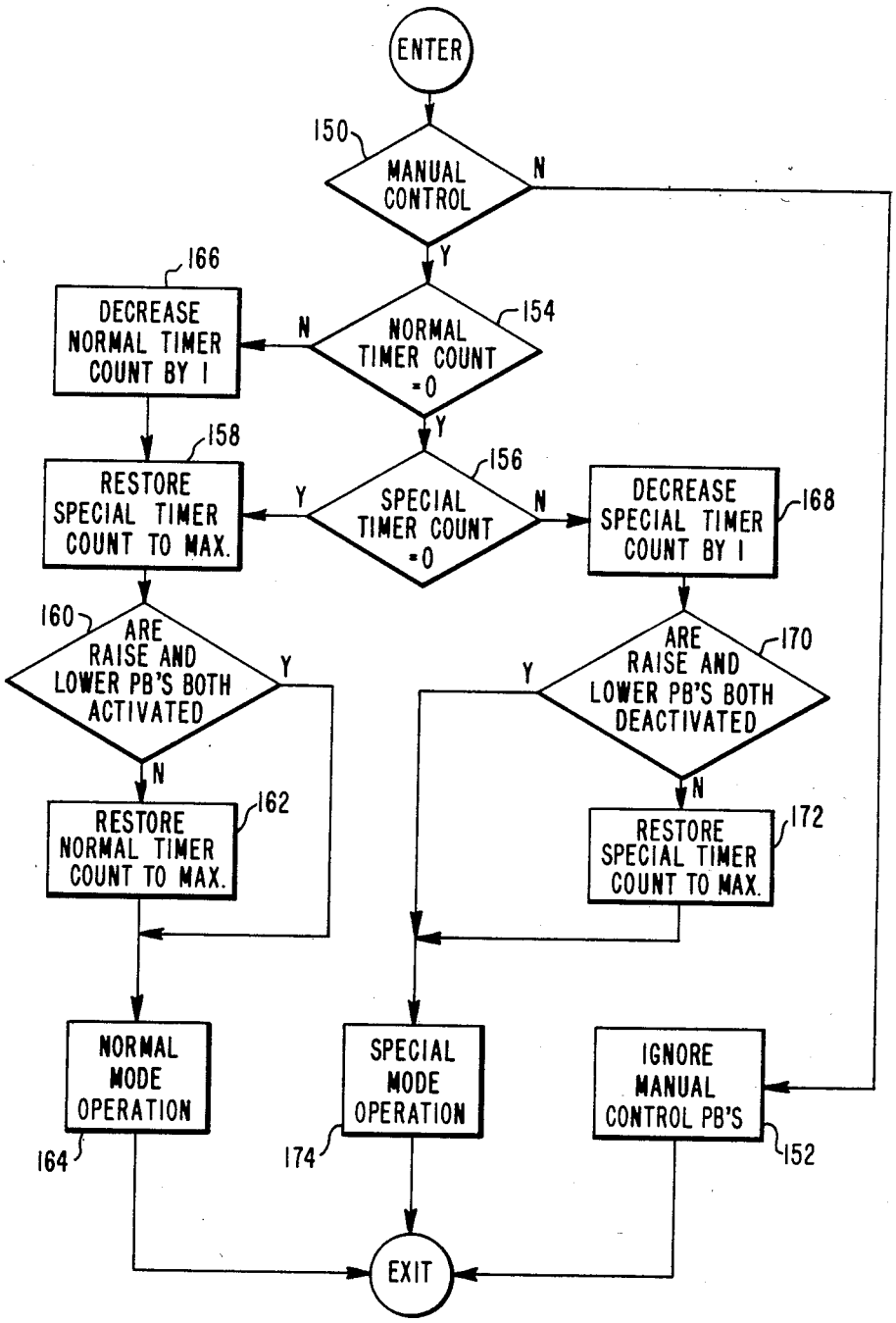
FIG. 5 is a flow chart functionally illustrating operation of an embodiment of the present invention.

The next time the routine of FIG. 5 is executed, the normal timer is at its maximum count and not zero as indicated by the question of decision block 154 to thereby effect a decrease of one in the timer count, as indicated by block 166. This count however is restored to its maximum value by block 162 and operation continues in the normal mode.

If, as in the example previously given, the governor valve raise pushbutton 136 is activated and remains in a stuck condition, then the operator will activate governor valve lower pushbutton 137 to stop movement of the valve. In such instance the raise and lower pushbuttons are both activated and the path from decision circuit 160 will bypass the restoration operation of block 162 such that each time the routine of FIG. 5 is executed, the operation of block 166 will decrement the normal timer count by one. After a predetermined time period as governed by the execution cycle time and maximum normal timer count, the normal timer will time out such that its count is zero and the path from decision block 154 will lead to decision block 156 and since the special timer count is not zero since it was previously restored by the operation of block 158, the maximum count of the special timer will be decremented by one as indicated by block 168.

As long as both the raise and lower pushbuttons are not deactivated, as indicated by decision block 170, then the special timer count is set to its maximum value as indicated by block 172 and the microcomputer control circuit will function in a special mode of operation as indicated by block 174 and which operation is summarized by the following chart.

SPECIAL MODE

| Raise Push-button (134 or 136) | Lower Pushbutton (135 or 137) | Fast Action Pushbutton (138) | Rapid Close Pushbutton (139) | Valve Response Valve Response |
|---|---|---|---|---|
| 1 | — | 1 | — | Valve raises at 33⅓% per min. |
| — | 1 | — | 1 | Valve lowers at 33⅓% per min. |
| 0 | 0 | — | — | Switch back to normal mode after 1 sec. |

If the stuck pushbutton condition is fixed, then the path from decision block 170 bypasses the restoration operation of block 172 such that on each execution the special timer count is decremented by one due to the operation of block 168 and will arrive at a zero count as a function of the execution cycle time and the maximum count of the special timer. With both timers timed out, operation commences in the normal mode as initially described.

Therefore, in the special mode of operation, the valves may still be raised and lowered even though a pushbutton is stuck. The raising is accomplished by joint activation of both the raise pushbutton 134 (or 136) and the fast action pushbutton 138. The lowering is accomplished by joint activation of both the lower pushbutton 135 (or 137) and the rapid close pushbutton 139. This latter combination in the normal mode would have caused lowering at a rate of 200% per minute but in the special mode is modified so as to cause lowering of the valve at the same rate as the raising thereof, that is, 33⅓% per minute, by way of example.

With a given execution cycle time, the predetermined time periods for switching from the normal mode to the special mode and vice versa may be selected by choice of the respective normal and special timer maximum counts which are decremented. These predetermined time periods are a matter of personal choice and the example of 5 seconds that the operator must hold the raise and lower pushbuttons in until switching over to the special mode, and one second for switching back to the normal mode after the stuck pushbutton is fixed, may be desirable, although longer or shorter periods of times may be selected.

What is claimed is:

1. In a steam turbine control system operable in an automatic or manual control mode for controlling movement of the steam admission valves of the steam turbine, the improvement comprising:

(A) a pair of manually activated switches for respectively opening and closing said valves at a first predetermined rate, when in said manual control mode;

(B) a set of additional switches for changing the rate of movement of said valves;

(C) control means operable in a normal mode of operation to control said valves in accordance with the activated or deactivated state of said switches and to switch to a special mode of operation if said pair of switches are both closed for a predetermined period of time;

(D) said control means being operable in said special mode of operation to move said valves at a predetermined rate only when a switch of said pair and a switch of said set are both activated and to switch back to said normal mode of operation if the switches of said pair are both deactivated for a predetermined period of time.

2. In a steam turbine control system operable in an automatic or manual control mode and having a control panel which includes a manual section for manually controlling movement of the steam admission valves of the steam turbine, the improvement comprising:

(A) a plurality of manually operated pushbuttons on said manual section and activation of which causes movement of said valves, when in said manual control mode;

(B) said plurality including respective pushbuttons for opening and closing the valves at a first rate and at least first and second additional pushbuttons for changing the rate of opening and closing of said valves;

(C) a plurality of valve position control circuits each including its own control means for controlling movement of a respective one of said valves;

(D) said control means being operable to repetitively examine the state of said pushbuttons to determine which ones have been activated;

(E) said control means being operable in both a normal and special mode of operation;

(F) said control means, when in said normal mode of operation, being operable to control its associated valve in accordance with activated pushbuttons and to switch to said special mode of operation if said pushbuttons for opening and closing said valves are concurrently activated for a first predetermined period of time;

(G) said control means, when in said special mode of operation, being operable to disregard certain activated pushbuttons and to open its valve at a predetermined rate only when said pushbutton for opening said valves and said first pushbutton are concurrently activated and to close its valve at a predetermined rate only when said pushbutton for closing said valves and said second pushbutton are concurrently activated;

(H) said control means being additionally operable to switch back to said normal mode of operation from said special mode only after both said pushbuttons for opening and closing said valves have remained deactivated for a second predetermined period of time.

3. Apparatus according to claim 2 wherein:

(A) said predetermined rates for opening and closing are the same.

4. Apparatus according to claim 3 wherein:

(A) said predetermined rates are greater than said first rate.

5. Apparatus according to claim 2 wherein:

(A) said first predetermined period of time for switching to said special mode is greater than said second predetermined period of time for switching back to said normal mode.

6. Apparatus according to claim 2 wherein:

(A) said steam admission valves include a plurality of throttle valves and a plurality of governor valves;

(B) said manual section includes two pushbuttons for respectively opening and closing said throttle valves at said first rate, two pushbuttons for respectively opening and closing said governor valves at said first rate, as well as said first and second pushbuttons for changing said rate.

* * * * *